US006253731B1

(12) United States Patent
Yoon

(10) Patent No.: US 6,253,731 B1
(45) Date of Patent: Jul. 3, 2001

(54) THROTTLE VALVE CONTROL SYSTEM FOR INTERNAL COMBUSTION ENGINE

(75) Inventor: Hun-Joung Yoon, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/422,033

(22) Filed: Oct. 20, 1999

(30) Foreign Application Priority Data

Mar. 12, 1999 (KR) ..... 99-8271

(51) Int. Cl.[7] ..... F02D 1/00
(52) U.S. Cl. ..... 123/396; 123/400
(58) Field of Search ..... 123/396, 399, 123/400

(56) References Cited

U.S. PATENT DOCUMENTS 4,969,437 * 11/1990 Kolb ..... 123/400
5,040,508 * 8/1991 Watanabe ..... 123/400
5,178,112 * 1/1993 Tarazawa et al. ..... 123/400
5,215,057 * 6/1993 Sato et al. ..... 123/400
5,367,997 * 11/1994 Kawamura et al. ..... 123/400

* cited by examiner

*Primary Examiner*—John Kwon
(74) *Attorney, Agent, or Firm*—Christie, Parker & Hale, LLP

(57) ABSTRACT

A throttle valve control system for internal combustion engines includes an accelerator pedal switch for detecting a depression amount of an accelerator pedal, an actuator for actuating a throttle valve according to electric signals from an ECU, an accelerator pulley fixedly mounted on a throttle spindle, and an accelerator cable one end of which is wound around the accelerator pulley and other end of which is connected to the accelerator pedal.

4 Claims, 4 Drawing Sheets

THROTTLE VALVE CONTROL SYSTEM FOR INTERNAL COMBUSTION ENGINE

BACKGROUND OF THE INVENTION (a) Field of the Invention

The present invention relates to a throttle valve control system for internal combustion engines and, more particularly, to an improved throttle valve control system for an Intelligent Speed Adaptation (ISA) system.

(b) Description of the Related Art

In recent years, much research and development have taken place regarding the concept of intelligent speed adaptation (ISA). Such a system is based on control of the throttle valve to restrict the injection of fuel into the engine when the vehicle reaches specific speed limit.

A conventional throttle valve control device for controlling fuel injection is shown in FIG. 4. Reference numeral 2 in the drawing indicates the throttle valve control device.

The throttle valve control device 2 is provided in a throttle body 4. The throttle valve control device 2 comprises a throttle valve 6, a rotational throttle shaft 8 for actuating the throttle valve 6, a first rotational plate 14 fixedly mounted at one end of the throttle shaft 8 and connected to an accelerator pedal 10 by an accelerator cable 12, and a second rotational plate 22 fixedly mounted at the other end of the throttle shaft 8 and connected to a motor 18 via a throttle cable 20.

The throttle valve control device 2 has two sources of operation, driver manipulation of the accelerator pedal 10 which operates the acceleration cable 12 then the first rotational plate 14, and the motor 18 which is controlled by an ECU 16 and operates the throttle cable 20 and the second rotational plate 22. Accordingly, the throttle valve control device 2 is operated in 3 operational modes: a manual mode, an automatic, and a dual mode.

In the manual mode, the throttle valve 6 is controlled by driver manipulation of the accelerator pedal 10. In this case, the depressing force applied by the driver on the accelerator pedal 10 is transmitted to the throttle shaft 8 via the acceleration cable 12 and the first rotational plate 14. That is, the first rotational plate 14 rotates in one direction in direct proportion to the degree to which the accelerator pedal 10 is depressed by the driver, and rotates in the other direction as the driver releases the depressing force on. At this time, although the motor 18 is connected to the second rotational plate 22, the motor 18 does not affect accelerator pedal manipulation because the ECU 16 does not supply electricity to the motor 18 in the manual mode.

In the automatic mode, the throttle valve 6 is actuated by the motor 18 by control of the ECU 16. In more detail, if the ECU 16 determines that the driver is not performing manual control of the throttle valve 6, the ECU 16 operates the motor 18 by supplying electricity thereto according to a driving state of the vehicle determined on the basis of the data detected by various sensors on the vehicle. In this case, the rotational force of the motor 18 is transmitted to the throttle shaft 8 via the throttle cable 20 and the second rotational plate 22. In the automatic mode, because the first rotational plate 12 is also fixedly connected to the throttle shaft 8, the accelerator pedal 10 moves without driver manipulation of the same in accordance with the rotation of the throttle shaft 8 in the automatic mode, In the dual mode, the throttle valve 6 can be controlled by both driver manipulation of the accelerator pedal 10 and the ECU 16. That is, a counterforce to the acceleration pedal 10 is given whenever the driver tries to depress the accelerator pedal 10 beyond a predetermined level (i.e., beyond a level which would driver the vehicle past a specific speed limit). However, in the dual mode, since driver manipulation of the accelerator pedal 10 ultimately has priority over automatic control of the throttle valve 6, it is not possible to control vehicle speed electrically if the driver continues to operate the accelerator pedal 10.

SUMMARY OF THE INVENTION

The present invention has been made in an effort to solve the above problems of the prior art.

It is an object of the present invention to provide an improved throttle valve control system for limiting the speed of a vehicle according to signals from speed limit beacons installed on roads, whenever a driver tries to depress an accelerator pedal beyond a pre-set speed limit.

To achieve the above object, the throttle valve control system of the present invention comprises an accelerator pedal switch for detecting a depression amount of an accelerator pedal, an actuator for actuating a throttle valve according to electric signals from an ECU, an accelerator pulley fixedly mounted on a throttle spindle, and an accelerator cable one end of which is wound around the accelerator pulley and other end of which is connected to the accelerator pedal, wherein the actuator is directly mounted to the throttle spindle.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will be described hereinafter with reference to the accompanying drawings.

Figure 1:
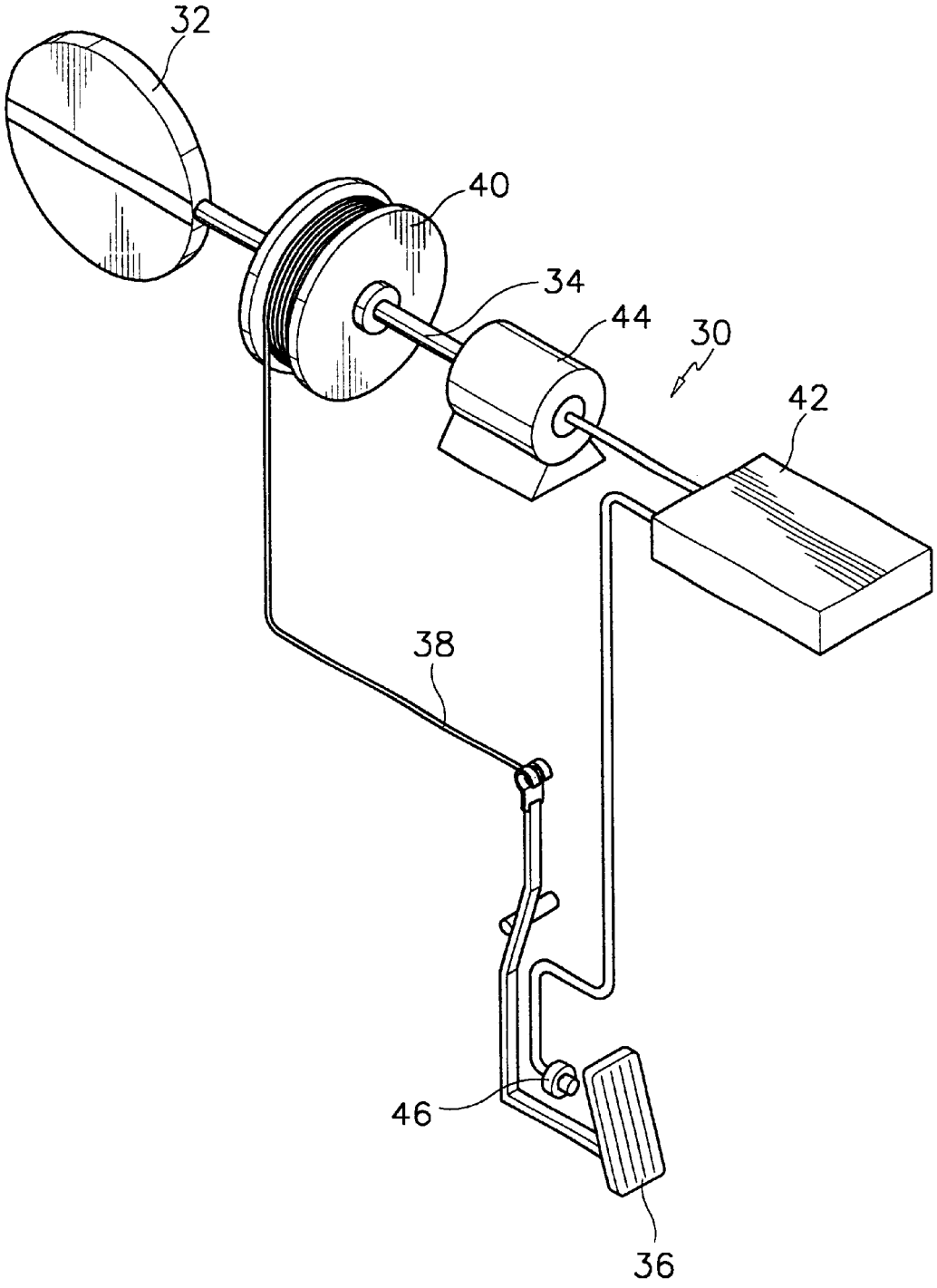
FIG. 1 is a perspective view of a throttle valve control device according to a preferred embodiment of the present invention.
Figure 2:
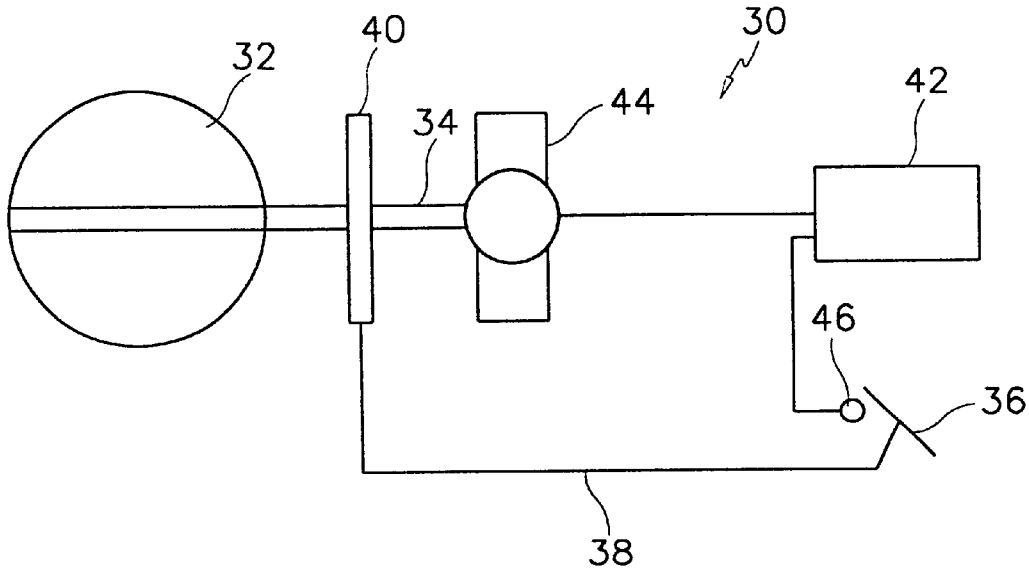
FIG. 2 is a schematic view of the throttle valve control device of FIG. 1.

FIG. 1 and FIG. 2 are respectively a perspective and schematic view of a throttle valve control device of the present invention.

As shown in FIG. 1 and FIG. 2, a throttle disc 32 is fixedly mounted at one end of a throttle spindle 34 for opening and closing a throttle bore (not shown), and a motor 44 which is controlled by an ECU 42 is directly mounted at the other end of the throttle spindle 34 for operating the throttle disc 32. An accelerator pulley 40, connected to an accelerator pedal 36 via an accelerator cable 38, is fixedly mounted on the throttle spindle 34 between the throttle disc 32 and the motor 44. The motor 44 is a step motor that can be controlled by electric signals. An accelerator pedal switch 46 is provided for detecting levels at which the accelerator pedal 36 has been depressed, after which corresponding data are sent to the ECU 42.

Figure 3:
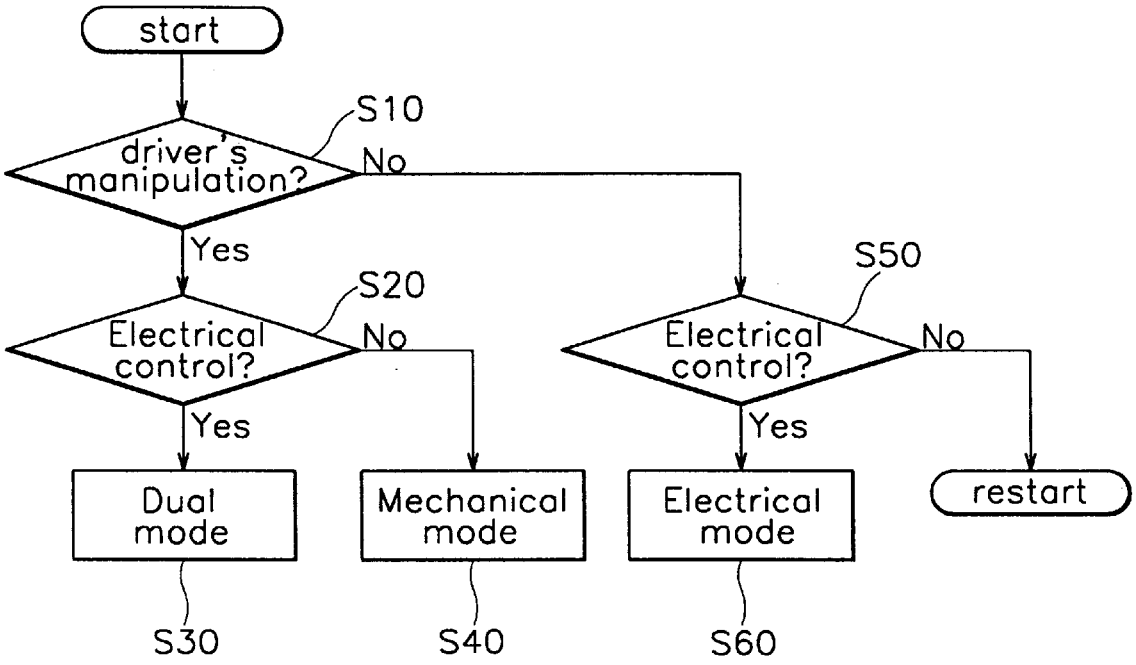
FIG. 3 is a flowchart describing an operation of the throttle valve control device of FIG. 1.
Figure 4:
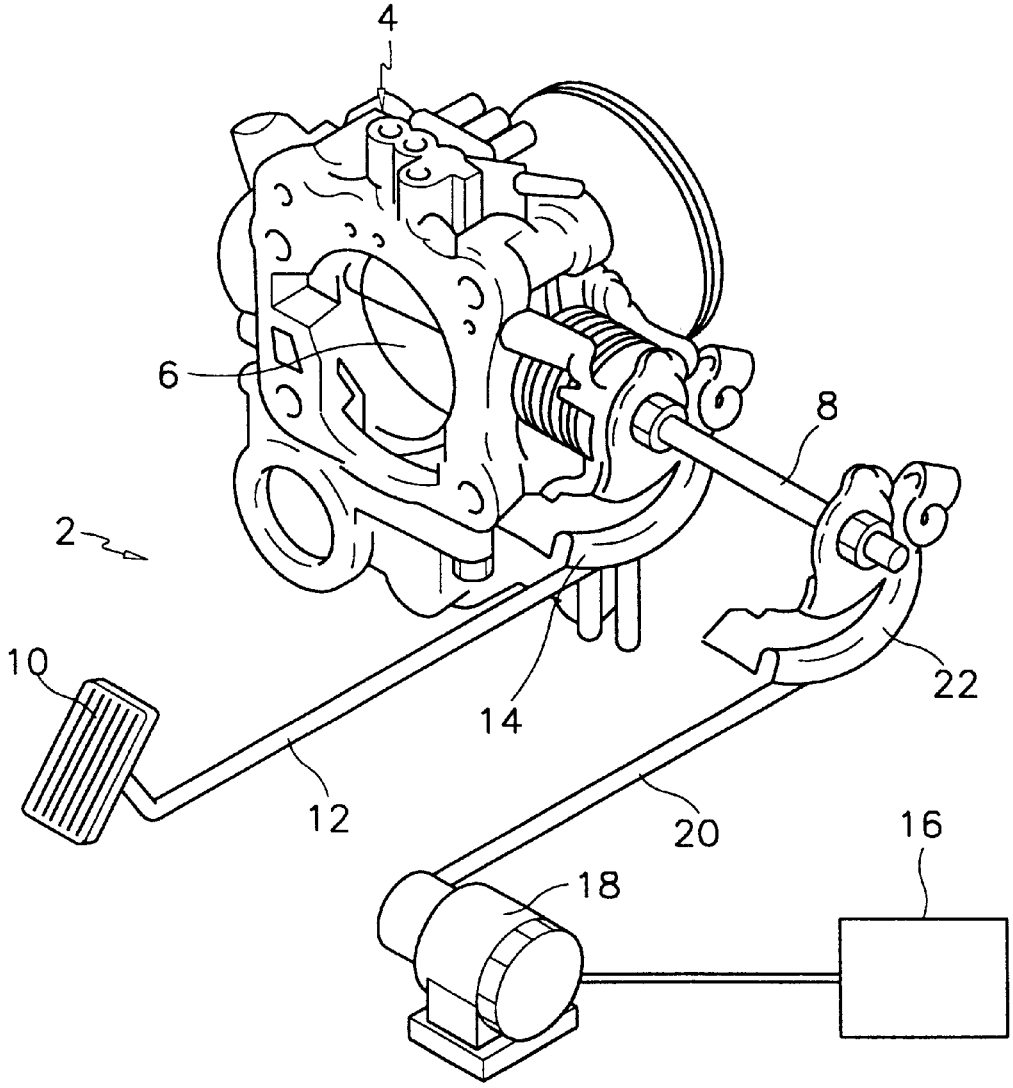
FIG. 4 Prior Art
FIG. 4 is a perspective view of a conventional throttle valve control device.

An operation of the throttle valve control device of the present invention will now be described with reference to FIG. 3.

First, the ECU 42 determines whether the accelerator pedal 36 is being operated by the driver in step S10. At this time, if the accelerator pedal 36 is being operated by the driver, the accelerator pedal switch 46 detects the amount the accelerator pedal 36 is depressed and sends a corresponding electric signal to the ECU 42. If the depression of the accelerator pedal 36 is detected, the ECU 42 determines whether electrical control is being performed in step S20. If it is determined that electrical control is being performed, the ECU 42 sets the throttle valve control device to a dual mode in which the device is controlled both mechanically and electrically in step S30. On the other hand, if it is determined that electrical control is not being performed in step S20, the ECU 42 sets the throttle valve control device to a mechanical mode in step S40.

In step S10, if the ECU 42 determines that the accelerator pedal 36 is not being operated by the driver, then it is determined whether electrical control is being performed in step S50. If it is determined that electrical control is being performed, the ECU 42 sets the throttle valve control device to an electrical mode in step S60. On the other hand, if it is determined that electrical control is not being performed in step S50, the progress restarts.

In the dual mode established in step S30, electrical control has priority over mechanical control. That is, the power of the motor 44 is such that it is greater than the power that can be exerted on the accelerator pedal 36 by the driver.

Thus, while the ECU 42 controls the motor 44 based on the data of the depression amount of the accelerator pedal 36 detected by the accelerator pedal switch 46, the driving of the engine is not affected by the depression amount of the accelerator pedal 36, because the power from the depression amount of the accelerator pedal 36 is already reflected in the throttle spindle 34 by the motor 44 through control of the ECU 42.

In the mechanical mode established in step S40, the electricity supplied to the motor 44 is cut by signals from the ECU 42 such that the throttle spindle 34 can freely rotate by driver manipulation of the acceleration pedal 36. The throttle valve control device is set in the manual mode at speed levels below the pre-set maximal speed.

In the electrical mode S60, the throttle disc 32 is actuated by the motor 44 under the control of the ECU 42. In this case, the accelerator pedal 36 moves according to the rotation amount of the motor 44 because the accelerator pedal 36 is connected to the throttle spindle 34 via the acceleration cable 38 and the acceleration pulley 40.

Since the ECU 42 has priority control over the throttle disc 32, when using the inventive throttle valve control device with an ISA system, the ECU 42 receives a wireless signal of maximal speed from beacons installed in a specific area and ensures that the vehicle does not exceed the speed limit in that area even if the driver depresses the accelerator pedal 36 past a level that would beyond the speed limit.

In the throttle valve control device of the present invention, the motor is directly connected with the throttle spindle such that the throttle valve opening can be precisely adjusted. Also, since the throttle valve control device is simple in structure through the use of one throttle pulley and one throttle cable by directly connecting the motor with the spindle disc, the weight and size of the device is reduced and its manufacturing costs are minimized.

Also, the throttle valve control device according to the present invention is ideal for application with an ISA system because the ECU controls the throttle valve to fully ensure the pre-set speed limit even if the driver tries to depress the accelerator pedal beyond a point that would drive the vehicle over the speed limit.

Although preferred embodiment of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A throttle valve control system for internal combustion engines comprising:

an accelerator pedal switch for detecting the travel of an accelerator pedal in the depressed direction;

an accelerator pedal to throttle valve linkage, wherein the linkage includes an accelerator pulley fixedly mounted on the throttle shaft;

an accelerator cable one end of which is wound around the accelerator pulley, the other end being connected to the accelerator pedal, wherein force is applied to the throttle valve via the accelerator linkage and pulley;

an actuator for actuating the throttle valve according to electrical signals from an electronic control unit, wherein the actuator is directly mounted to the throttle spindle, and further wherein the actuator has sufficient power to overcome the force applied to the throttle valve via the accelerator pedal and linkage.

2. The throttle valve control system of claim 1, wherein the actuator, accelerator pulley, and throttle valve are all mounted on a single shaft.

3. The throttle valve control system of claim 1, wherein the accelerator pulley moves within a predetermined angular range.

4. The throttle valve control system of claim 1, wherein the actuator is a stepper motor.

* * * * *